US006629865B2

(12) United States Patent
Bungo

(10) Patent No.: US 6,629,865 B2
(45) Date of Patent: Oct. 7, 2003

(54) ZERO TERMINAL INSERTION FORCE ELECTRICAL CONNECTION ASSEMBLY

(75) Inventor: Edward M. Bungo, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/012,587

(22) Filed: Dec. 7, 2001

(65) Prior Publication Data

US 2003/0109181 A1 Jun. 12, 2003

(51) Int. Cl.[7] ..... H01R 11/22
(52) U.S. Cl. ..... 439/852; 439/268
(58) Field of Search ..... 439/852, 849, 439/850, 854, 862, 839, 268, 342, 259, 266

(56) References Cited

U.S. PATENT DOCUMENTS

| | | | | | |
|---|---|---|---|---|---|
| RE31,142 | E | * | 2/1983 | Simmons | 439/74 R |
| 4,415,221 | A | * | 11/1983 | Inoue et al. | 439/258 |
| 4,560,231 | A | * | 12/1985 | Shirai | 439/258 |
| 4,699,444 | A | * | 10/1987 | Isohata | 439/839 |
| 4,934,966 | A | * | 6/1990 | D'Urso | 439/849 |
| 4,973,271 | A | * | 11/1990 | Ishizuka et al. | 439/839 |
| 5,066,253 | A | * | 11/1991 | Kameyama | 439/752 |
| 5,525,070 | A | * | 6/1996 | Axelsson | 439/268 |
| 5,735,717 | A | * | 4/1998 | Nabeshima | 439/851 |
| 6,171,146 | B1 | | 1/2001 | Fink et al. | |

OTHER PUBLICATIONS

"Metri–Pack" Connection System of Delphi Technologies, Inc., Troy, MI on Market Since Before 1990.

AMP 495P Micro PGA Fact Sheets of AMP Div. of Tyco Intl, Ltd., Pembroke HM08, Bermuda 10 PGS Dated: Nov. 17, 1999.

PGA 370 ZIF Socket Fact Sheets of FCI Automotive N.A. Livonia MI 48152 5 pgs Dated: Feb. 24, 1999.

AMP LIF PGA Socket Fact Sheets of AMP Div of Tyco Intl, Ltd, Pembroke HM08 Bermuda 2PGS Date Unspecified.

* cited by examiner

*Primary Examiner*—Renee Luebke
*Assistant Examiner*—Phuongchi Nguyen
(74) *Attorney, Agent, or Firm*—Thomas N. Twomey

(57) ABSTRACT

A zero terminal insertion force electrical connection assembly. A female terminal features a barrel having a floor, a roof and an opening. Connected to the floor is a tongue which curves inwardly and upwardly into the barrel, and has an interface surface located adjacent the roof when the tongue is in a relaxed state. A boss feature is connected to the tongue and passes though an aperture in the roof when the tongue is in its relaxed state. A zero insertion force member is slidably interfaced with the barrel such that at a first position, the boss feature projects fully through the aperture. However, when slid to a second position, the zero insertion force member presses upon the boss feature so as to cause the tongue to be resiliently depressed toward the floor and allow a male terminal to be slid receivingly into the barrel without any contact with the tongue. Yet, when the zero insertion force member is returned to the first position the tongue resiliently rebounds such that the interface surface of the tongue is in good abutting electrical contact with the male terminal by virtue of the resilient normal force of the tongue.

3 Claims, 4 Drawing Sheets

ZERO TERMINAL INSERTION FORCE ELECTRICAL CONNECTION ASSEMBLY

TECHNICAL FIELD

The present invention relates to electrical connectors, and more particularly to a female terminal having a selectively operable zero insertion force mechanism for zero force insertion and removal of a male terminal with respect thereto.

BACKGROUND OF THE INVENTION

Electrical connectors generally have two metallic engaging terminals which must be in intimate contact for a good electrical connection therebetween to be maintained over the life of the connection. The intimate contact may be by a permanent affixment, as for example by a threaded fastener or a weld. However, for many purposes the connection must be selectively reversible. One connector configuration which serves this purpose is a male terminal (as for example in the form of a pin or a blade) and a female terminal configured for receiving therein the male terminal. An example of a female terminal and male terminal combination configured for selectively reversible connection is depicted at FIGS. 1 through 2B, and is indicative of a "Metri-Pack" connection system of Delphi Technologies, Inc. of Troy, Mich.

As shown at FIG. 1, the female terminal 10 has a generally rectangular barrel 12 at one end and wire affixment features 14, 16 at the other end. Referring now additionally to FIG. 2A, it is further seen that a tongue 18 is located at the opening 20 and interior of the barrel 12. The tongue is connected to a floor 22 of the barrel 12, extends outwardly from the opening 20, then curves inwardly and upwardly so that an interface surface 24 of the tongue 18 is generally located at the roof 26 of the barrel 12. Pressure tabs 28 are located at a medial location of the tongue 18 and face toward the floor 22.

Referring now additionally to FIG. 2B, as a male terminal 30, which may be for example a blade (as shown) or a pin, is inserted into the opening 20 along arrow A, the male terminal encounters the interface surface 24 of the tongue 18, and in order for its continued insertion to be achieved, the tongue must be resiliently forced downwardly along arrow B by the male terminal. When the male terminal 10 is fully seated inside the barrel 12, the tongue applies sufficient resilience force upwardly along arrow C to cause an excellent intimate electrical contact between the male terminal and the interface surface (which is, for example, tin plated).

A disadvantage of the female terminal 10 is that a large terminal engagement force is required during mating because of the necessity of the male terminal to force resilient bending of the tongue. Disadvantageously, repeated insertions/removals of the male terminal results in wear of the plating of the mutually abutting surfaces subjected to the tongue normal force.

Accordingly, it would be beneficial if somehow the male terminal could be inserted into the female terminal with zero terminal insertion force and zero contact between the male terminal and the tongue.

SUMMARY OF THE INVENTION

The present invention is a zero terminal insertion force electrical connection assembly featuring zero terminal insertion force during mating of a male and female terminal combination.

The female terminal according to the present invention features a barrel having a floor, a roof and an opening. The roof has an aperture formed therein. Connected to the floor is a tongue which extends outwardly from the opening and then curves inwardly and upwardly into the barrel. The tongue has an interface surface located adjacent the roof when the tongue is in a relaxed state. A boss feature is connected to the tongue adjacent the interface surface and extends uptandingly though the aperture in the roof when the tongue is in the relaxed state.

A zero insertion force member is slidably interfaced with the barrel such that at a first position, the boss feature projects fully through the aperture. However, when slid to a second position, the zero insertion force member presses upon the boss feature so as to cause the interface surface of the tongue to be resiliently depressed toward the floor. Accordingly, when the zero insertion/extraction force member is at the second position, a male terminal may be slid receivingly into the barrel through the opening and be fully received without any contact with the tongue. As a result of the cooperative interaction of the boss feature and the zero insertion force member, the insertion and removal of the male terminal with respect to the female terminal is accomplished without terminal insertion force and without scrapping between the male terminal and the tongue. Yet, when the zero insertion force member is returned to the first position, the tongue resiliently rebounds so that the interface surface of the tongue comes into good abutting electrical contact with the male terminal by virtue of the resilient normal force of the tongue.

Accordingly, it is an object of the present invention to provide an electrical connection between two electrical terminals in which zero terminal insertion force is involved.

It is an additional object of the present invention to provide an electrical connection between two electrical terminals in which zero terminal insertion force is involved and wherein the mating and unmating of the terminals is accomplishable without scrapping between the electrical contact surfaces.

These and additional objects, features and advantages of the present invention will become clearer from the following specification of a preferred embodiment.

DESCRIPTION OF THE PREFERRED EMBODIMENT

Figure 1:
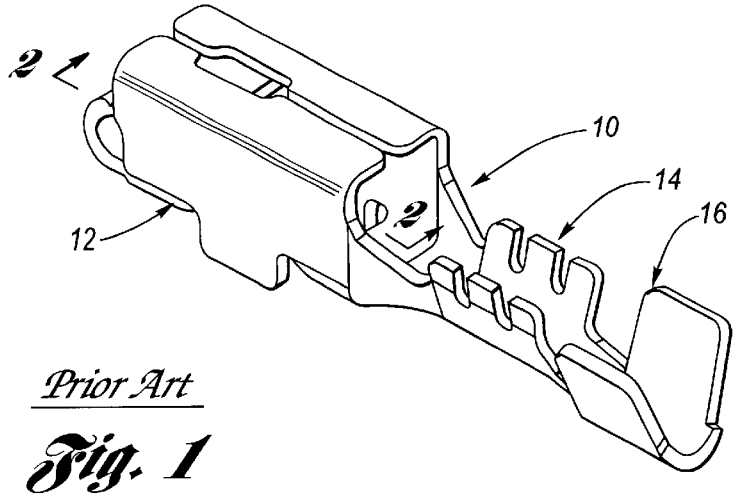
Prior Art Fig. 1
FIG. 1 is a perspective view of a prior art female electrical terminal.
Figure 2A:
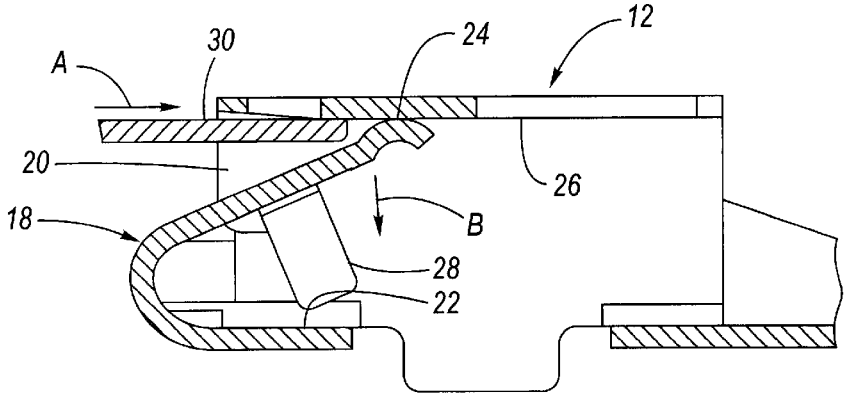
Prior Art Fig. 2A
FIG. 2A is a partly sectional, broken-away side view of the prior art female electrical terminal of FIG. 1, wherein a male terminal is shown at an early stage of insertion.
Figure 2B:
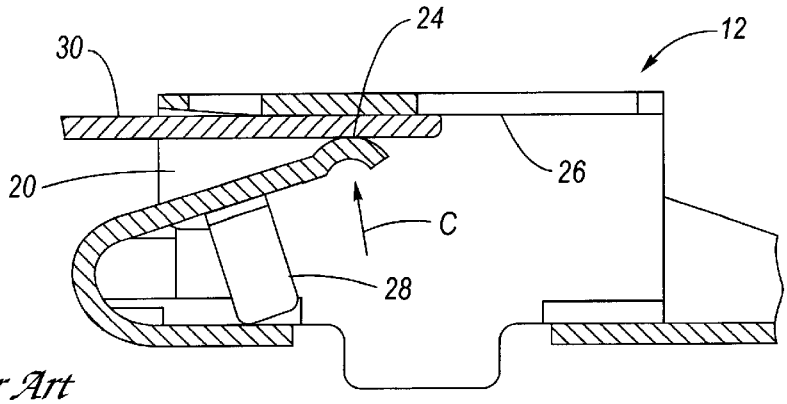
Prior Art Fig. 2B
FIG. 2B is a is a partly sectional, broken-away side view of the prior art female electrical terminal of FIG. 1, wherein a male terminal is shown fully inserted.
Figure 3:
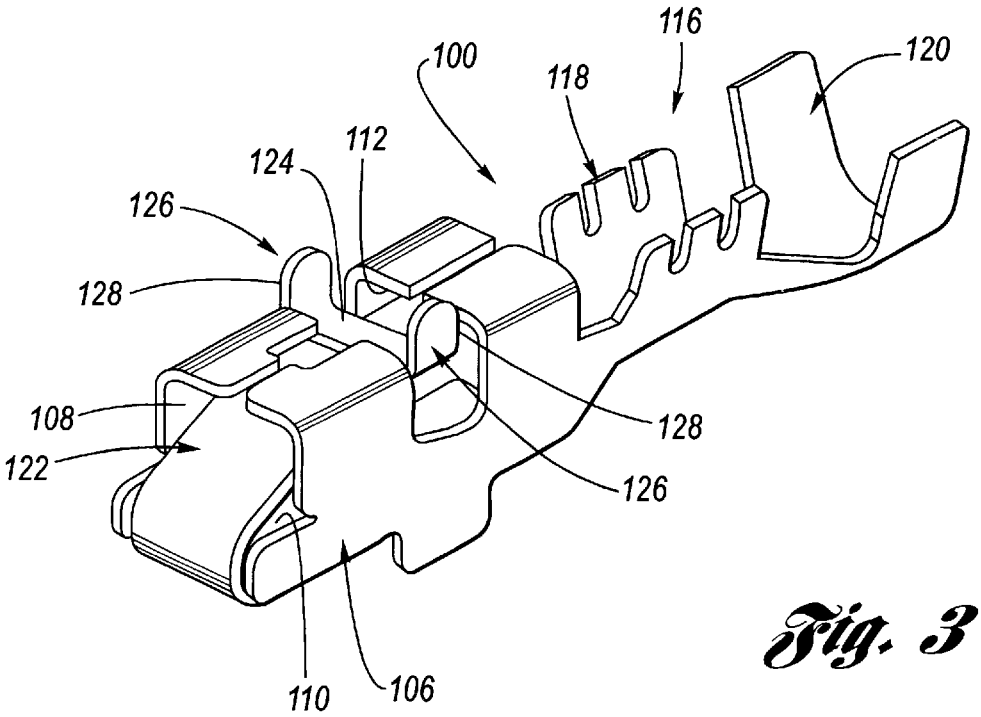
FIG. 3 is a perspective view of a female terminal according to the present invention.
Figure 4:
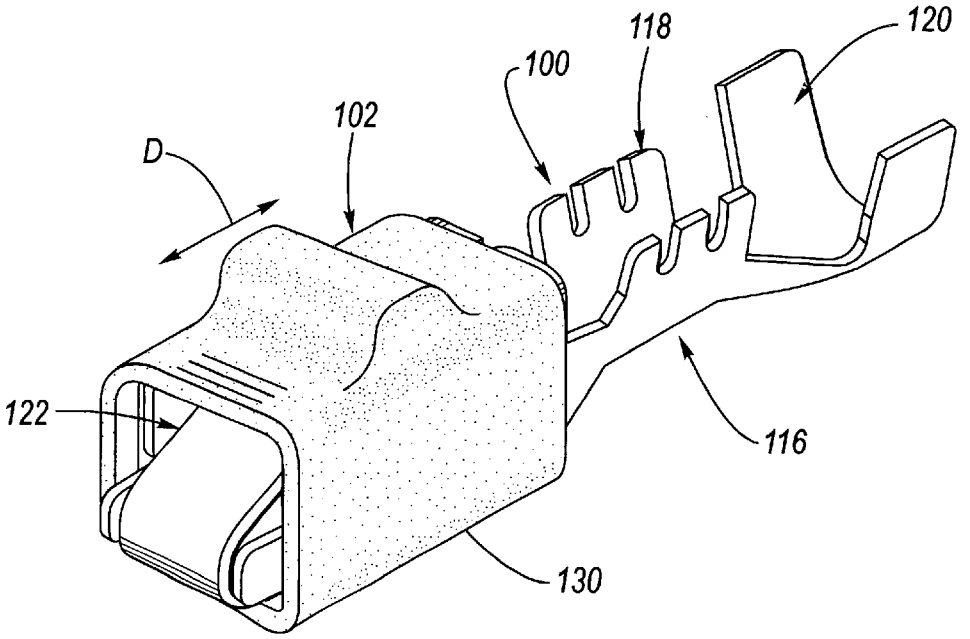
FIG. 4 is a perspective view of a female terminal according to the present invention having a zero insertion mechanism slidably connected thereto.
Figure 5A:
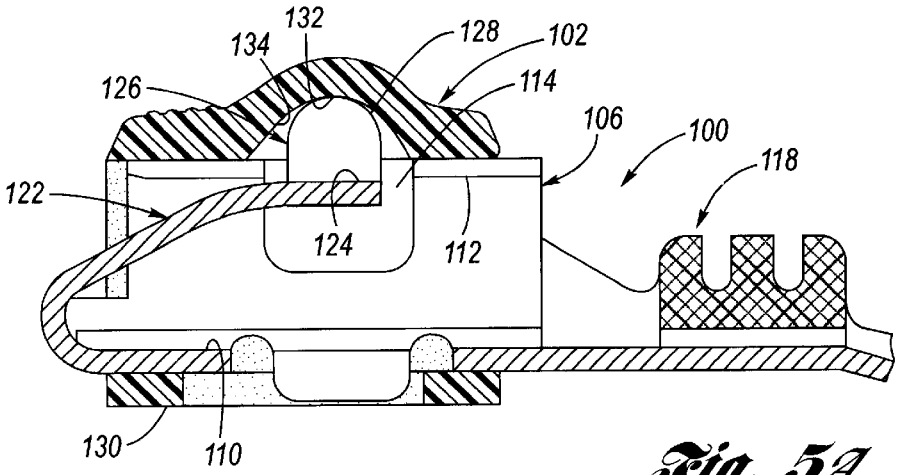
FIGS. 5A through 5C are side views of the female terminal of FIG. 3 with the zero insertion force member as depicted at FIG. 4, at various stages of insertion thereinto by a male terminal.
Figure 5B:
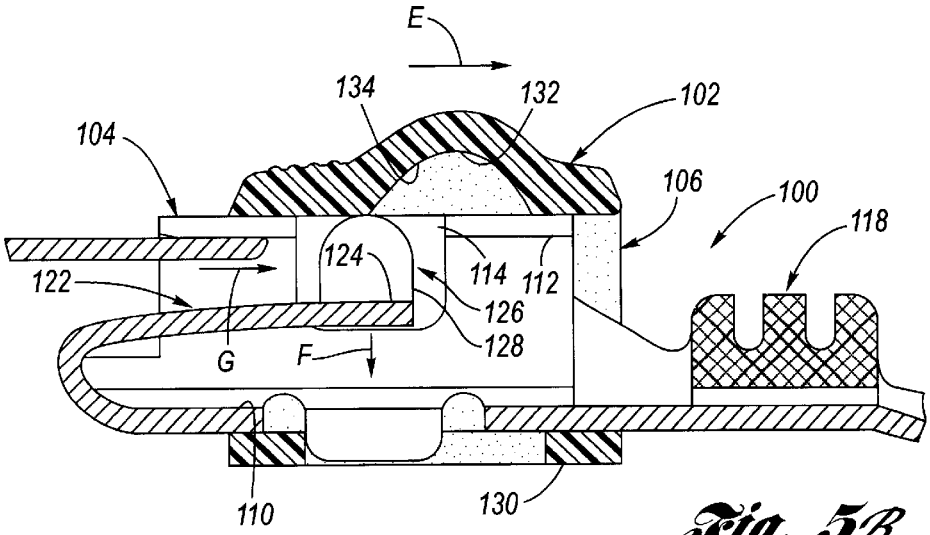
Figure 5C:
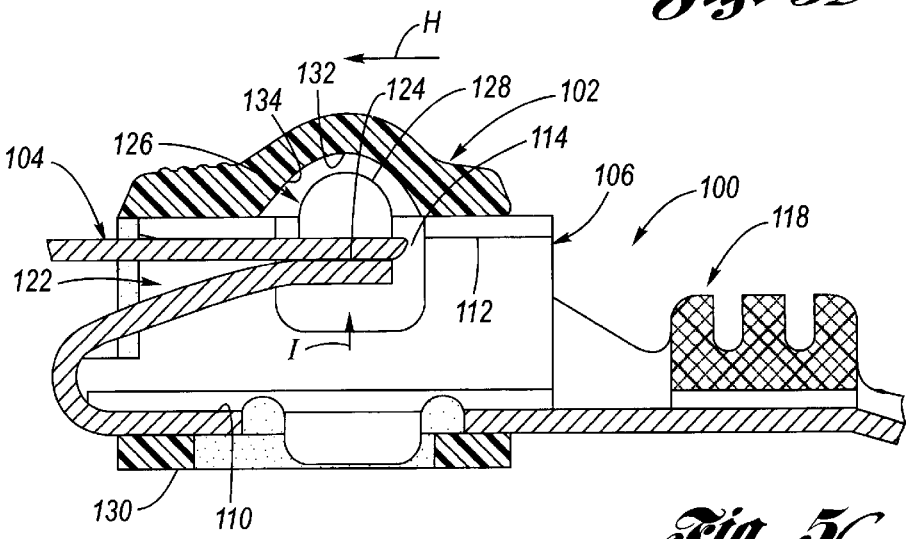
Figure 6A:
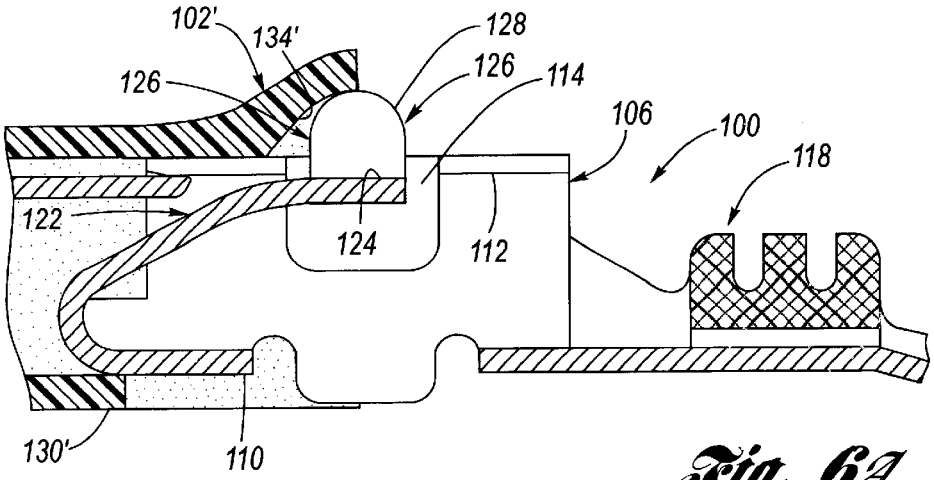
FIGS. 6A through 6C are side views of the female terminal of FIG. 3 with a zero insertion force member slidably connected with a male terminal, at various stages of insertion into the female terminal by the male terminal.
Figure 6B:
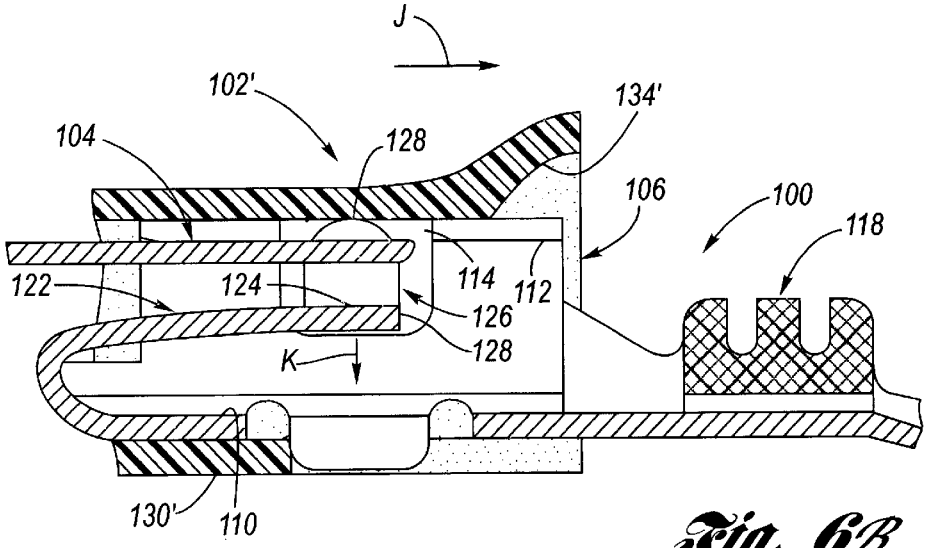
Figure 6C:
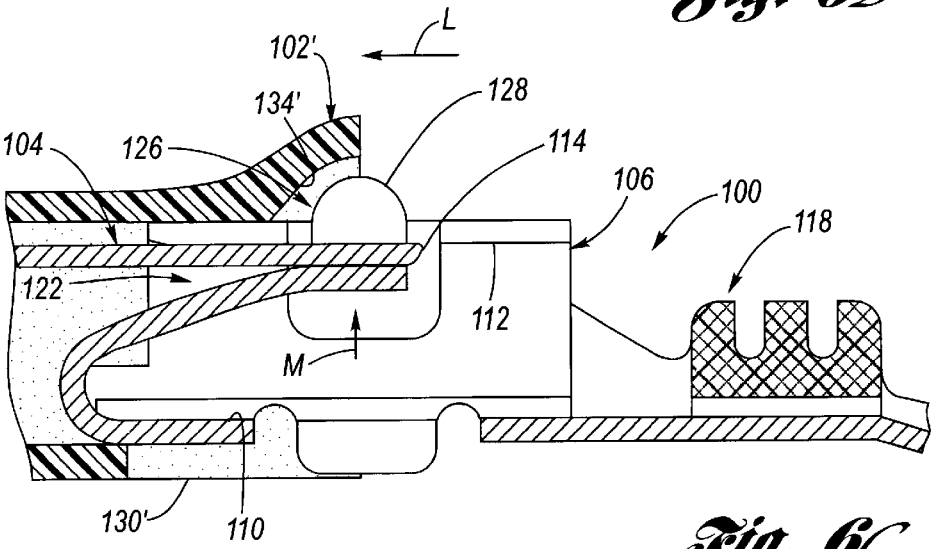

Referring now to the Drawing, FIGS. 3 through 6C depict examples zero insertion force electrical connectors according to the present invention, wherein a female terminal 100 is slidably interfitted with a zero insertion force member 102 in FIGS. 4 through 5C, and wherein a male terminal 104 is slidably interfitted with a modified zero insertion force member 102' in FIGS. 6A through 6C.

As shown at FIG. 3, the female terminal 100 is composed of a metal, preferably, but not necessarily a tin plated metal, and includes a barrel 106 having an opening 108, a floor 110 (seen best at FIG. 5A), a roof 112 (also seen best at FIG. 5A), and an aperture 114 formed in the roof. Connected to the barrel 106 opposite the opening 108 is a wire affixment appendage 116 including a bare wire crimp member 118 and an insulation jacket crimp member 120. A resilient tongue 122 is connected to the floor 110, extending outward in relation to the opening 108 and then curving inward and upward toward the roof 112. The tongue 122 has an interface surface 124 for abutting a male terminal, wherein the interface surface is located adjacent the roof when the tongue is in its relaxed state. Adjacent the interface surface 124 is a boss feature 126, preferably for example in the form of generally semicircular wings 128 respectively located on either side of the tongue. The boss feature 126 upstandingly extends generally normal to the interface surface 124 and passes through the aperture 114 and protrusively with respect to the roof 112 when the tongue is in its relaxed state.

Turning attention now to FIG. 4, the aforementioned zero insertion force member 102 is in the form of a preferably plastic sheath body 130 which encompasses the barrel 106. Adjacent the roof 112, the sheath body 130 has a cavity 132 (seen best at FIG. 5A) which has a curved or otherwise acutely angled engagement surface 134 for cammingly interacting with the boss feature 126 (ie., the wings 128). The configuration of the sheath body 130 is such as to allow a defined back and forth sliding movement along a terminal axis D.

FIGS. 5A through 5D indicate operatively how a male terminal 104, as for example either in the form of a metallic pin or metallic blade (as shown) is able to be mated and unmated from the female terminal 100 with zero terminal insertion force and zero contact between the male terminal and the interface surface 124 of the tongue 122.

The zero insertion force member 102 is shown at a first position of operation in FIG. 5A, wherein the wings 128 are resident in the cavity 132, with the tongue 122 in its relaxed state.

FIG. 5B depicts the zero insertion force member now slid along arrow E to a second position, wherein the engagement surface 134 of the cavity 132 has cammed the wings downwardly toward the floor 110 so as to be generally flush to the top surface of the roof 112. The downward movement of the boss feature 126 (ie., the wings 128) results in the tongue 122 being resiliently bent as the interface surface 124 moves along arrow F toward the floor 110. Because the movement of the interface surface 124 toward the floor 110, the tongue 122 is completely out of the way of the male terminal 104 as it is inserted along arrow G into the female terminal 100, so that no terminal insertion force is involved and no contact is involved between the male terminal and the interface surface.

As shown at FIG. 5C, after the male terminal 104 has been fully inserted into the female terminal 100, the zero insertion force member 102 is now slid back along arrow H to the first position, whereat the boss feature 126 (ie., the wings 128) resides again in the cavity 132. In this regard, the engagement surface 134 again cammed with respect to the wings 128, in this case allowing the tongue 122 to resiliently rebound along arrow I toward its relaxed state. However, the relaxed state of FIG. 5A is not attained because the male terminal 104 is now present and interferes with a full rebound of the tongue. Accordingly, the tongue 122 applies a resilient normal force onto the male terminal 104 which thereby supplies a good abutting electrical connection between the interface surface 124 and the male terminal.

It is clear from the foregoing exposition, that in order to remove the male terminal 104 from the female terminal 100 with a zero terminal extraction force and with zero contact with the interface surface, the zero insertion force member 102 need simply be again slid to the second position prior to extraction of the male terminal.

FIGS. 6A through 6C depict a variation in the foregoing description, wherein a modified zero insertion force member is slidably attached to the male terminal 104, as for example in the form of a modified sheath body 130' which is slidably interfaced to a plastic overmold of a distal portion of the male terminal.

The zero insertion force member 102' is shown at a first position of operation in FIG. 6A relative to the male terminal 104, wherein the tongue 122 in its relaxed state. The zero insertion force member 102' has an engagement surface 134' at a forward end thereof. At FIG. 6A, the zero insertion force member 102' is shown at a first position relative to the male terminal 104 as the male terminal is initially inserting into the female terminal 100.

FIG. 6B depicts the final insertion of the male terminal 104, wherein the male terminal and the zero insertion force member 102' moved in concert with each other (ie., the zero insertion force member remained at the first position) simultaneously along arrow J. Prior to the male terminal 104 contacting the tongue 122, the engagement surface 134' cammed the wings downwardly toward the floor 110 so as to be generally flush to the top surface of the roof 112. The downward movement of the boss feature 126 (ie., the wings 128) resulted in the tongue 122 being resiliently bent as the interface surface 124 moves along arrow K toward the floor 110. Because the movement of the interface surface 124 toward the floor 110, the tongue 122 was completely out of the way of the male terminal 104 as it is inserted into the female terminal 100, so that no terminal insertion force is involved and no contact is involved between the male terminal and the interface surface.

As shown at FIG. 6C, after the male terminal 104 has been fully inserted into the female terminal 100, the zero insertion force member 102' is now slid along arrow L to a second position relative to the male terminal 104, during which movement the engagement surface 134 again cams with respect to the wings 128, in this case allowing the tongue 122 to resiliently rebound along arrow M toward its relaxed state. However, the relaxed state of FIG. 6A is not attained because the male terminal 104 is now present and interferes with a full rebound of the tongue. Accordingly, the tongue 122 applies a resilient normal force onto the male terminal 104 which thereby supplies a good abutting electrical connection between the interface surface 124 and the male terminal.

It is clear from the foregoing exposition, that in order to remove the male terminal 104 from the female terminal 100 with a zero terminal extraction force and with zero contact with the interface surface, the zero insertion force member

102' need simply be again slid to the first position prior to extraction of the male terminal.

To those skilled in the art to which this invention appertains, the above described preferred embodiment may be subject to change or modification. For example, the female terminal 100 may be used manually without the assist of a zero insertion force member to provide insertion/removal of a male terminal with zero force and zero tongue contact by hand depression of the boss feature 126 (in which case the boss feature may be structured for a more comfortable hand contact). Such change or modification can be carried out without departing from the scope of the invention, which is intended to be limited only by the scope of the appended claims.

What is claimed is:

1. A zero insertion force electrical connection assembly comprising:

a female terminal comprising:

a barrel having a floor, a roof and an opening, wherein an aperture is formed in said roof;

a resilient tongue connected to said floor and curvably extending inwardly and upwardly with respect to said barrel, wherein said tongue has an interface surface located adjacent said roof when said tongue is in a relaxed state; and a boss feature connected to said tongue and protruding outwardly from said roof through said aperture; and a zero insertion force member slidably interfaced with said barrel for sliding between a first position relative to said barrel and a second position relative to said barrel, said zero insertion force member having a cavity for receiving therein said boss feature when said tongue is in said relaxed state, said cavity having an engagement surface which cams interacting with said boss feature;

wherein when said boss feature is subjected to a depression force toward said floor said tongue is caused to resiliently bend such that said interface surface moves toward said floor, and upon removal of the depression force the tongue resiliently rebounds such that said interface surface moves toward said roof;

wherein at said first position of said zero insertion force member said tongue is at said relaxed state, and wherein when said zero insertion force member is moved to said second position said boss feature is cammed by said engagement surface so as to cause said interface surface to be depressed away from said roof and toward said floor; and wherein said boss feature comprises a pair of wings respectively located on each side of said tongue substantially adjacent said interface surface.

2. A zero insertion force electrical connection assembly comprising:

a female terminal comprising:

a barrel having a floor, a roof and an opening, wherein an aperture is formed in said roof, a resilient tongue connected to said floor and curvably extending inwardly and upwardly with respect to said barrel, wherein said tongue has an interface surface located adjacent said roof when said tongue is in a relaxed state; and a boss feature connected to said tongue and protruding outwardly from said roof through said aperture;

a male terminal; and a zero insertion force member slidably interfaced with said male terminal for sliding between a first position relative to said male terminal and a second position relative to said male terminal, said zero insertion force member having an engagement surface which cams interacting with said boss feature;

wherein as said male terminal is inserted into said female terminal and said zero insertion force member is at said first position said tongue is cammed by interaction of said engagement surface with said boss feature toward said floor so that said male terminal inserts with a zero terminal insertion force, and wherein thereafter when said zero insertion force member is moved to said second position said tongue resiliently rebounds such that said interface surface abuts against said male terminal; and wherein said boss feature comprises a pair of wings respectively located on each side of said tongue substantially adjacent said interface surface.

3. A method for inserting a male terminal into a female terminal with zero terminal insertion force and zero terminal-to-terminal contact, comprising the steps of:

fabricating a female terminal having a barrel and a resilient tongue connected to said barrel, the tongue curving inwardly and upwardly with respect to said barrel;

depressing the tongue by an object other than said male terminal;

inserting a male terminal into said barrel contactlessly with respect to said tongue; and releasing depression of the tongue by the object so that the tongue resiliently rebounds and thereupon applies a normal force onto the male terminal;

wherein said steps of depressing and releasing comprise:

sliding a zero insertion force member from a first position to a second position relative to said tongue where during said zero insertion force member causes said tongue to be depressed; and sliding the zero insertion force member from the second position to the first position where during the zero insertion force member releases the depression of the tongue.

* * * * *